United States Patent [19]

Ott

[11] 4,004,184

[45] * Jan. 18, 1977

[54] APPARATUS FOR OPERATING GASEOUS DISCHARGE LAMPS ON DIRECT CURRENT FROM A SOURCE OF ALTERNATING CURRENT

[75] Inventor: Henry Whitfield Ott, Sarasota, Fla.

[73] Assignee: John Ott Laboratories, Inc., Sarasota, Fla.

[ * ] Notice: The portion of the term of this patent subsequent to June 16, 1992, has been disclaimed.

[22] Filed: June 6, 1975

[21] Appl. No.: 584,400

Related U.S. Application Data

[62] Division of Ser. No. 443,825, Feb. 19, 1974, Pat. No. 3,890,540.

[52] U.S. Cl. ..... 315/101; 315/94; 315/200 R; 315/202; 315/DIG. 5

[51] Int. Cl.[2] ..... H05B 41/16

[58] Field of Search ..... 315/94, 101, 200 R, 315/205, DIG. 4, DIG. 5, 98, 99, 105, 106, 202, 246

[56] References Cited

UNITED STATES PATENTS

| | | | |
|---|---|---|---|
| 2,864,035 | 12/1958 | Davis | 315/335 X |
| 3,514,667 | 5/1970 | Dessoulavy et al. | 315/DIG. 5 |
| 3,638,070 | 1/1972 | Powell | 315/205 X |
| 3,801,867 | 4/1974 | West et al. | 315/DIG. 5 |
| 3,890,540 | 6/1975 | Ott | 315/335 |

FOREIGN PATENTS OR APPLICATIONS

| | | | |
|---|---|---|---|
| 187,153 | 1/1966 | U.S.S.R. | 315/101 |

*Primary Examiner*—Eugene La Roche
*Attorney, Agent, or Firm*—Richard E. Hosley

[57] ABSTRACT

A system providing flickerless operation of a gaseous discharge lamp utilizes a DC voltage applied across the lamp electrodes. Low starting voltage and power consumption are obtained by applying an AC voltage across a grounded conductor member and adjacent lamp electrodes.

2 Claims, 1 Drawing Figure

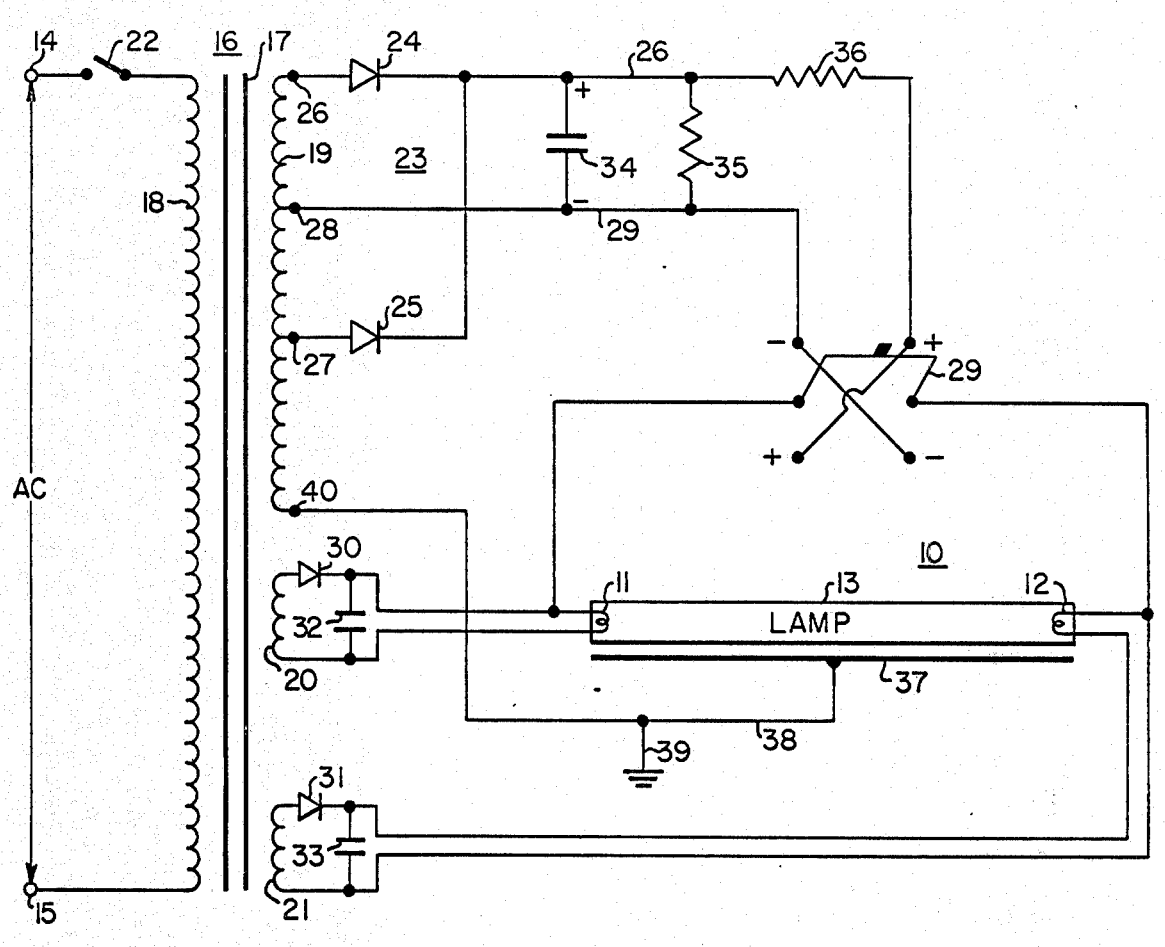
14
22
16
17
24
26
36
26
19
23
34
35
18
28
29
25
27
29
AC
40
30
10
11
13
12
32
LAMP
20
37
39
38
31
33
15
21

APPARATUS FOR OPERATING GASEOUS DISCHARGE LAMPS ON DIRECT CURRENT FROM A SOURCE OF ALTERNATING CURRENT

This is a division of application Ser. No. 443,825, filed Feb. 19, 1974, now U.S. Pat. No. 3,890,540.

BACKGROUND OF THE INVENTION

The present invention relates to apparatus for starting and for operating, on direct current, gaseous discharge lamps such as fluorescent lamps from a source of alternating current.

Fluorescent lamps are widely used for domestic and industrial lighting because they generate less heat and are more efficient than other common light sources such as incandescent lamps. They are ordinarily operated on alternating current (AC) because AC power sources are readily available and because AC systems provide certain advantages in ballasting and obtaining adequate starting voltage for the lamp. However, AC operation of fluorescent lamps has several disadvantages. Because the arc in the lamp must strike at twice the frequency of the AC supply current a flickering light is produced. Thus, when operated on 60 $H_z$ current, the lamp produces 120 flashes per second. This flickering effect can cause headache and eyestrain in some individuals and can cause epileptics to go into seizure. Also, because of the rapid rise in arc current in the lamp at each flash, the lamp emits a broad band of radio frequency radiation which causes interference problems in lighting applications where there is sensitive electronic equipment in an area lighted by fluorescent tubes.

To obviate the above difficulties of light flicker and unwanted radiation gaseous discharge lamps can be operated on direct current and this has been done where direct current (DC) power sources are conveniently available as on some subway trains. However, the available power supply is ordinarily AC and this requires the use of special rectifier, ballast and starting circuits for the lamp which have heretofore been expensive and relatively inefficient. This has limited the use of DC operated fluorescent lamps to a few special cases where DC power supplies are available or special applications such as photoprinting lights where the extra cost of the power rectification apparatus can be justified.

The reason prior apparatus for operating gaseous discharge lamps on DC from an AC source has been expensive and relatively inefficient stems from the electrical operating characteristics of such lamps. It is well known that they have an inherent negative resistance-current characteristic so that after the lamp arc strikes, the lamp current will become excessive unless a suitable ballasting device is used. Ballasts used in DC systems heretofore have caused substantial power loss often exceeding the loss in the lamp itself. Also, such lamps normally have a starting voltage substantially higher than the operating voltage. In DC systems the rectifiers must be able to withstand the high starting voltage or alternatively some automatic control system must be provided to isolate the rectifiers from the high starting voltage. Also, in such systems the starting voltage has been obtained by using apparatus such as a pulse transformer for superimposing AC on the DC current supplied to the lamp electrodes. This AC will cause the lamp to flicker unless manual or automatic apparatus is provided to remove it from the circuit after starting. Such apparatus adds considerably to the cost.

Accordingly, it is an object of the invention to provide improved apparatus for operating gaseous discharge lamps on DC from a source of AC that is less costly and more efficient than apparatus heretofore used for this purpose.

Another object of the invention is to provide an improved circuit and apparatus for operating gaseous discharge lamps without flicker and without objectionable radiation in the radio frequency range.

A still further object of the invention is to provide apparatus for starting and operating gaseous discharge lamps that does not require a ballast transformer or series reactor to obtain stable operation.

Further objects and advantages of the invention will become apparent as the following description proceeds.

SUMMARY

Briefly, in accordance with the invention the lamp starting and operating apparatus comprises a rectifier having an input circuit energized from a source of AC through a conventional voltage-changing transformer. The output circuit of the rectifier is connected to the lamp electrodes to provide a DC operating current for the lamp. To reduce the starting voltage and assist in the starting of the lamp a grounded conductor member is placed in close proximity to the lamp so that a small capacity exists between the conductor member and the electrodes of the lamp. Circuit connections to the transformer are such that an AC voltage exists between the conductor member and the lamp electrodes causing a small capacitive current to flow in the conductor but not in the lamp arc current flowing between the electrodes so that it does not produce lamp flicker. A small series ballast resistor in the rectifier output circuit is used to stabilize the lamp current.

For a better understanding of the invention, reference should be made to the following detailed description taken in connection with the accompanying drawing.

BRIEF DESCRIPTION OF THE DRAWING

The single FIGURE of the drawing is a circuit diagram showing apparatus in schematic form for starting and operating a fluorescent lamp which embodies the present invention.

DESCRIPTION OF THE ILLUSTRATED EMBODIMENT

Referring now to the drawing, there is shown apparatus for starting and for operating on direct current a fluorescent lamp 10. The lamp shown is a common hot cathode rapid start type having electrodes 11 and 12 at opposite ends of the tube envelope 13. The electrodes are a coiled filament type which are continuously heated during the lamp operation. The lamp is energized from a suitable source of alternating current (AC) supplied to input terminals 14 and 15.

The apparatus utilizes a conventional voltage-changing power transformer 16 comprising a magnetic core 17 on which are wound in inductive relation, a primary winding 18 and three secondary windings 19, 20 and 21. The primary winding 18 is connected to the AC input terminals 14 and 15 through a lamp starting switch 22.

A full wave rectifier, indicated generally by number 23, is provided for furnishing direct current (DC) to the electrodes 11 and 12 for flickerless operation of the lamp. The rectifier, in the form illustrated, has two diodes 24 and 25 whose cathodes are coupled to the positive side 26*a* of the rectifier output circuit. The anode of the rectifier diode 24 is connected to one end connection 26 of the transformer secondary winding 19 while the anode of the other rectifier diode 25 is connected to a winding tap connection 27. An intermediate winding tap connection 28 of the winding 19 is connected, as shown, to the negative side 29 of the rectifier output circuit. The secondary winding 19 of the transformer 16 may be considered as two series-connected sections with a first section extending between connections 26 and 27 and a second section extending between connectors 27 and 40. As so considered it will be noted that the rectifier 23 is connected to the first section. The function of the second section will become apparent as the following description proceeds. The positive and negative sides 26*a* and 29 of the rectifier output circuit are connected to the lamp electrodes 11 and 12 through a polarity reversing switch 29. By reversing the polarity of the current supplied to the lamp electrodes with this switch, the degradation of the lamp cathodes and the migration of the phosphor coating on the inside of the tube can be equalized in a known manner. The polarity reversing switch can be manually or automatically operated.

The cathode heaters of the electrodes 11 and 12 are energized from the heater windings 20 and 21 of transformer 16. In order to eliminate all flicker from the lamp, the cathode heaters are preferably energized with direct current. To provide such current rectifier diodes 30 and 31 are placed in the heater circuits along with the usual filter capacitors 32 and 33. Alternatively, switches may be provided to disconnect the heater circuits after the lamp has started.

In order to remove any AC ripple from the lamp arc current flowing between lamp electrodes 11 and 12 a filter capacitor 34 is connected across the positive and negative sides 26 and 29 of the rectifier output circuit and this capacitor is bridged by the usual bleeder resistor 35. Also included in the rectifier output circuit is a series-connected ballast resistor 36. The voltage drop across the resistor acts to stabilize the arc current of the lamp which would otherwise tend to run away due to negative resistance-current characteristic of fluorescent and other types of gaseous discharge lamps.

The starting voltage necessary to start a gaseous discharge lamp is normally substantially higher than the operating voltage required to maintain the flow of current through the lamp after the arc has been struck. In prior DC gaseous discharge lamp systems energized from AC supplies, this additional starting voltage has been obtained by superimposing on the DC rectifier output an AC voltage obtained from a pulse transformer or the like. This AC voltage must be removed after the lamp starts or it will cause a flicker in the lamp light output. This adds complication and cost. Also high leakage recictance transformers or ballasts have been required to provide a high open circuit starting voltage which drops after the lamp current starts to flow. Usually there is substantial power loss in such high reactance transformers or ballasts which reduces the efficiency of the system. These disadvantages are obviated in the present system by applying both AC and DC to the lamp electrodes during both starting and running conditions as will now be described.

To reduce the starting voltage and aid in starting of the lamp, there is provided a conductor member 37 which extends along the length of the lamp in closely spaced relation therewith so that a small capacity exists between the conductor member and the lamp electrodes 11 and 12. The conductor member is connected by a lead 38 to a ground connection 39 and also to an end terminal 40 of the second section of the secondary winding 19 of the transformer 16. Because the outer end connection 40 of the transformer secondary winding 19 is grounded, the potential of lamp electrodes 11 and 12, which are connected to the first winding section operating at different potential by virtue of the series connection between the winding sections, alternately swings above and below ground at the frequency of the AC supply. Thus an AC voltage is applied across the conductor member 37 and the lamp electrodes which causes a small capacitive current to flow therebetween. Since this current does not flow in the DC arc current flowing between the lamp electrodes, it does not cause any lamp flicker. Because of this and the fact that the capacitive current is small the AC voltage across the conductor member and lamp electrode can be left on during lamp operation without flicker effects or any appreciable power loss. Thus no manual or automatic switching equipment is required to disconnect the starting voltage.

In many applications a metallic lamp fixture in which the lamp 10 is housed may be used as the conductor member 37. Since the conductor member is at ground potential, there is no shock hazard. In other applications a conductor strip may be fastened along the length of the lamp envelope.

It has been found that the combination of DC voltage applied across the lamp electrodes and AC voltage applied across the conductor strip and the lamp electrodes has the effect of substantially reducing the voltage across the electrodes required to start the lamp. Thus with an 18 inch, 15 watt rapid start fluorescent lamp of the type illustrated and with about 150 volts AC applied across the conductor member and the lamp electrodes, the lamp was found to start consistently with a DC starting voltage of only 55 volts as compared with a normal starting voltage of about 110 volts. Also the lamp was found to operate in a stable manner and without flicker with a ballast resistor 36 having a resistance value of only 10 ohms. Thus the power loss in the resistor was negligible.

Because of the low starting voltage a ballasting transformer or reactor and high voltage rectifiers are not required. Thus the power loss and extra cost associated with such devices is avoided. The DC in the lamp arc and heater circuits eliminates lamp flicker and since the arc is steady rather than oscillating radio frequency noise problems are eliminated.

From the foregoing, it will be apparent that there has been provided a system and apparatus for flickerless operation of a gaseous discharge lamp that is simple, efficient and can be manufactured at a low cost as compared with previous equipment for performing the same function. The system may be used with other types of metallic vapor arc discharge lamps which normally require high starting voltages and have negative resistance-current characteristics.

While there has been shown what is presently considered to be a preferred embodiment of the invention, it will be apparent to those skilled in the art that various changes and modifications may be made therein without departing from the spirit and scope of the invention.

What is claimed as new and desired to be secured by Letters Patent of the U.S. is:

1. Apparatus for operating a gaseous discharge lamp from an AC power source so as to provide flickerless operation of the lamp, said lamp having a pair of electrodes across which a voltage is applied to start and operate the lamp and a filament heater associated with at least one of said electrodes, said apparatus comprising:

a. rectifier means having an input circuit connected to be energized by said AC power source and an output circuit connected to the lamp electrodes for operating the lamp on a DC current flowing between the electrodes, b. a heater circuit adapted to be energized from said AC power source for supplying heater current continuously during operation of the lamp to said heater independently of the current flowing between the lamp electrodes, and c. additional rectifying means for rectifying the current in the heater circuit whereby DC is supplied to said heater to prevent flicker of said lamp during operation.

2. The combination of claim 1 including heater supply transformer means adapted to be energized from said AC power source having secondary winding means connected to energize the heater circuit.

* * * * *